United States Patent [19]

Strangman

[11] Patent Number: 4,867,639

[45] Date of Patent: Sep. 19, 1989

[54] ABRADABLE SHROUD COATING

[75] Inventor: Thomas E. Strangman, Phoenix, Ariz.

[73] Assignee: Allied-Signal Inc., Morris Township, Morris County, N.J.

[21] Appl. No.: 99,810

[22] Filed: Sep. 22, 1987

[51] Int. Cl.[4] ..... F01D 11/08

[52] U.S. Cl. ..... 415/173.4; 228/120; 428/117

[58] Field of Search ..... 415/170 R, 174, 128, 415/196, 197, 200; 228/120; 428/117, 593, 421

[56] References Cited

U.S. PATENT DOCUMENTS

| | | | |
|---|---|---|---|
| 2,742,224 | 4/1956 | Burhans | 415/9 |
| 3,836,156 | 9/1974 | Dunthorne | 415/174 |
| 3,890,067 | 6/1975 | Rao et al. | 418/121 |
| 3,918,925 | 11/1975 | McComas | 29/182.3 |
| 4,247,249 | 1/1981 | Siemers | 415/174 |
| 4,252,408 | 2/1981 | Parsons et al. | 350/96.33 |
| 4,265,688 | 5/1981 | Gorski | 428/117 |
| 4,273,824 | 6/1981 | McComas et al. | 415/200 |
| 4,280,975 | 7/1981 | Ammann | 415/200 |
| 4,289,446 | 9/1981 | Wallace | 415/174 |
| 4,289,447 | 9/1981 | Sterman et al. | 415/200 |
| 4,395,196 | 7/1983 | Plautz | 415/200 |
| 4,405,284 | 9/1983 | Albrecht et al. | 415/174 |
| 4,460,311 | 7/1984 | Trappmann et al. | 415/116 |
| 4,639,388 | 1/1987 | Ainsworth et al. | 428/117 |
| 4,669,955 | 6/1987 | Pellow | 415/174 |

*Primary Examiner*—Robert E. Garrett
*Assistant Examiner*—John T. Kwon
*Attorney, Agent, or Firm*—R. Steven Linne; James W. McFarland

[57] ABSTRACT

Abradable coatings are applied to turbine or compressor shroud structures to facilitate reductions in blade tip-to-shroud clearances for improved engine performance or airfoil durability. Coating compositions include a chemically table, soft, burnishable ceramic material (such as $CaF_2$ or $BaF_2$) in a ceramic or metallic matrix or honeycomb structure.

19 Claims, 1 Drawing Sheet

ABRADABLE SHROUD COATING

TECHNICAL FIELD

This invention relates generally to ceramic surface coatings on parts having relative motion therebetween and more specifically to insulative and abradable coatings used in turbomachines on stationary surfaces surrounding rotating parts subject to occasional rubbing.

BACKGROUND ART

In axial flow gas turbines, the rotating compressor comprises one or more bladed discs (each constituting a "stage") mounted on a shaft which is supported at spaced points within the compressor housing or shroud. The turbines are assembled with a clearance gap between the rotor elements and the surrounding shroud to allow for differential thermal expansion between the various elements and/or minor displacement of the axis of rotation of the shaft due to operating loads.

However, to minimize losses of efficiency due to recirculation, the clearance gap should be designed to be as small as possible during operation.

This is especially true for small, highly-loaded, low-aspect-ratio turbines which are extremely sensitive to tip leakage losses. The clearance between the blade tip and the shroud is relatively greater when the blade length is small and thus has more of an effect on turbine performance. This presents a problem because of the temperature rises in the device, the differences in the coeffiecient of expansion of the various parts causes the gap size to change. It is thus necessary either to leave a large enough gap to allow for the expansion at all extremes of operating temperature or to provide for temporary or limited rubbing of the rotating and stationary parts during certain transient conditions while providing some means for preventing damage to the parts.

The prior art has tried several different approaches to solving this problem. One approach is to try to maintain both the shroud and rotor components at nearly the same temperature so that they will expand at the same rate and thereby maintain a constant running clearance. See, for example, U.S. Pat. No. 3,039,737.

Another approach is to provide an aerodynamic seal between the shroud and blades by extending the blade tip into a circumferential trench formed into the shroud and/or by attaching devices to the blade tips to direct gases away from the clearance gap. See, for example, U.S. Pat. Nos. 2,927,724, 3,583,824 and 3,701,536.

Yet another approach is allow the shroud, or a portion thereof, to be deformed, in a non-destructive manner, by the rotating components themselves so that only enough clearance is formed to accommodate the thermal expansion experiences in a particular engine. This latter approach was investigated further during development of the present invention.

One method which allows the shroud to be deformed into close running relationship with the rotating blades involves providing a fragile metallic honeycomb or cellular structure on the interior of the shroud and allowing the rotation of the blades cut a close fitting path through the fragile structure. See, for example, U.S. Pat. Nos. 3,689,971, 4,063,742, 4,526,509 and 4,652,209.

Another method involves coating the shroud interior with a soft or porous metal layer so that, again, the rotating blades can cut, or abrade, a path through the material. See, for example, U.S. Pat. Nos. 4,664,973 and 4,671,735.

U.S. Pat. No. 2,742,224 to F. M. Burhans for a "Compressor Casing Lining" appears to teach a shroud coating material which has a very sharp, but low, melting temperature so that any frictional heat due to rubbing will cause the coating to immediately melt and pass through the turbine without damage. Suggested materials are: indium, tin, cadmium, lead, zinc, and certain aluminum alloys.

U.S. Pat. No. 3,836,156 to H. B. Dunthorne for an "Ablative Seal" appears to teach a very similar concept except that the materials suggested are brazing alloys useful at higher temperatures.

U.S. Pat. Nos. 4,405,284, 4,460,311 and 4,669,955 teach the use of hard, brittle ceramic materials, including a honeycomb structure, which may be abraded or worn away during the initial run-in of a new turbine assembly. Suggested compositions include zirconia, $ZrO_2$, MgO, and alumina or the like.

Several problems still exist in providing an effective and inexpensive abradable material. For example, the porous metals are difficult to attach securely to the base material of the shroud and are also often degraded by the absrasive and/or erosive action of the hot gas stream. The honeycomb material must be very fragile so as not to damage the blades but yet it must be substantial enough to be handled during manufacture and installation without deforming.

Most importantly, both types of seals suffer the limitation that the very high local temperature generated at the line of contact may be sufficient to flow the surface material so that when the rubbing ceases, a hard skin is formed which could damage the rotating blades at the next contact.

Thus, there is a need in this art for an improved abradable sealing material and structure for allowing its use in gas turbines.

None of the foregoing suggest the structure and composition of the present invention. Generally similar ceramic compositions are, of course, well known for other uses. See, for example, U.S. Pat. No. 4,252,408.

DISCLOSURE OF THE INVENTION

The present invention aims to overcome the disadvantages of the prior art as well as offer certain other advantages by providing a novel shroud coating system which incorporates a chemically stable, soft, burnishable ceramic material having a relatively low melting temperature. Of particular interest are low melting fluoride compounds (such as $BaF_2$, $CaF_2$, and $MgF_2$) which are incorporated into a higher melting temperature ceramic matrix (for example, stabilized zirconia and/or alumina) or a metallic matrix (such as NiCr or NiCrAl) or a fibrous metallic structure. Alternately, the soft ceramic phase may be used to fill or impregnate a honeycomb shroud lining made of the higher melting temperature, hard ceramic or metal alloy so that the soft ceramic is not eroded by the hot gases.

The soft ceramic phase will enhance shroud abradability by becoming molten whenever the rotating blades rub the shroud and, upon resolidification, will improve the smoothness of the abraded surfaces, thus increasing aerodynamic performance while avoiding undue wear of the turbine blades.

While this specification concludes with claims particularly pointing out and distinctly claiming the subject matter which is regarded as the invention, it is believed that the objects, features and advantages thereof may be better understood from the following detailed description of a presently preferred embodiment when taken in connection with the accompanying drawings. It being understood, however, that this invention is not limited to the precise arrangements and instrumentation shown.

BEST MODE FOR CARRYING OUT THE INVENTION

Figure 1:
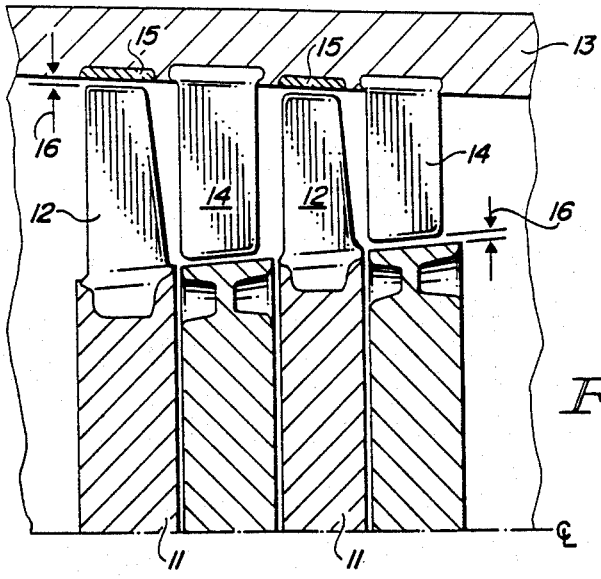
FIG. 1 is a fragmentary illustration of an interior portion of a turbine showing the turbine blade region.

Referring now to FIG. 1, a turbine includes several rotatable disks (11) carrying axial-flow blades (12) on their outer periphery. A casing (13) or shroud structure surrounds the rotatable components, and typically carries stationary vanes (14), for confining and guiding hot gases flowing through the turbine.

The shroud (13) is provided with a seal structure (15) arranged on at least the portion of the shroud which is adjacent the tips of the rotor blades (12). The clearance gap (16) between the blades (12) and the seal (15) is very important as previously discussed.

Figure 2:
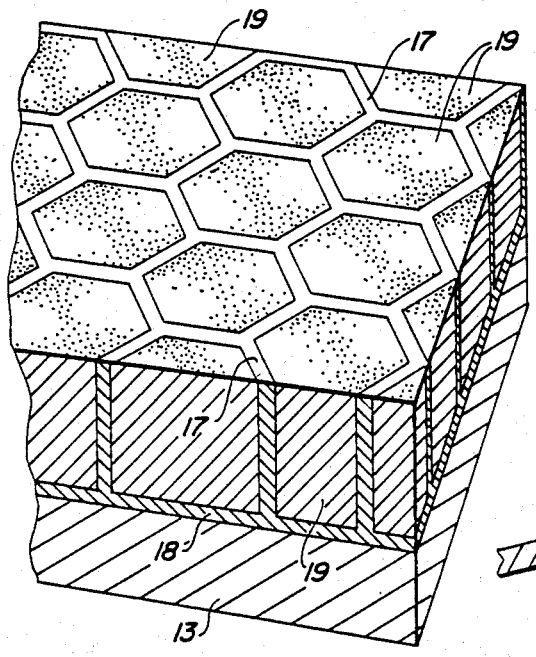
FIG. 2 is an illustration of one form of the present seal structure.

In the fragmentary perspective view of FIG. 2, an intermediate step in the manufacture of the preferred seal structure (15) is shown in more detail. A metallic honeycomb (17) is first brazed (18) onto the interior shroud wall (13) or a separate support plate (20) shown in FIG. 3. The soft ceramic phase (19) is poured or sprayed into the open cells of the honeycomb (17) and is supported thereby.

Instead of brazing an expensive prefabricated honeycomb (17) onto the shroud (13) or support plate (20), a known fibrous metallic felt like structure may be bonded, by brazing for example, or a porous powdered metal or ceramic matrix may be bonded by thermal spraying for example, to the shroud and the soft ceramic phase can be impregnated into the pores thereof to form a functionally equivalent seal structure.

Alternately, the soft ceramic phase may be mixed with a presently used high temperature ceramic and the mixture bonded directly to the shroud (13) or support (20) by known methods. Preferably, the soft ceramic phase comprises at least 5%, and no more than 50%, of the total seal volume so that it will not be easily eroded by the hot gas stream during normal use of the turbine.

Figure 3:
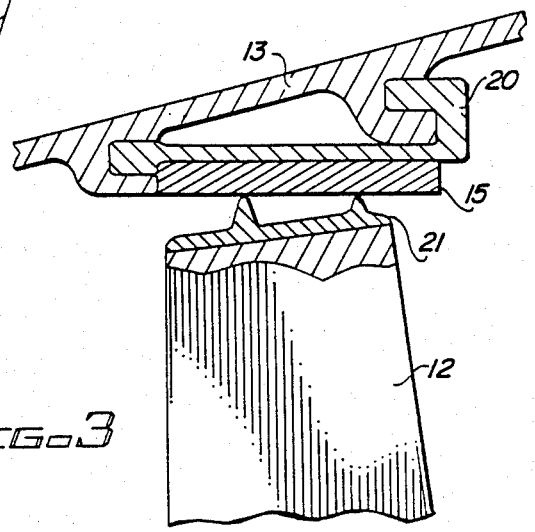
FIG. 3 is an illustration of an alternate seal mounting structure.

After the seal structure is installed on the turbine shroud, it is typically machined to a diameter which just allows assembly of the disks (11) and blades (12). Later, during operation of the turbine, thermal expansion will cause the blades (12) to contact and further deform the seal structure (15) to provide the necessary running clearances. As shown in FIG. 3, the ends of the blades (12) may be coated with a hard layer (21), which may include projections, to help prevent rapid wear due to contact with the seals.

The melting temperature of the soft ceramic phase should be just higher than the maximum service temperature of the turbine so that it will not melt during normal use but can be melted by the additional frictional heat during a blade rub.

The melting temperature of the soft ceramic can be tailored to meet specific engine requirements by selecting appropriate mixtures of the fluorides. For example, $CaF_2$ melts at about 1410° C., $BaF_2$ melts at about 1380° C., and the eutectic mixture of 70% $BaF_2$ - 30% $CaF_2$ melts at about 1050° C. Other similar mixtures may also be useful in certain engines (e.g., 72% $BaF_2$ - 16% $CaF_2$ - 12% $MgF_2$ melts at about 800° C., which is too low for most engines unless the shroud is cooled).

While the invention has been described in terms of one preferred embodiment, it is expected that alternatives, modifications, or permutations thereof will be apparent to those skilled in the art. Therefore, it is intended that equivalents be embraced within the spirit and scope of the invention as defined by the appended claims.

What is claimed is:

1. An abradable seal suitable for use between a rotatable component and a stationary component of turbomachinery comprising a mixture of soft, burnishable ceramic material, selected from the group of fluoride compounds, incorporated into a stronger support matrix.

2. An abradable seal suitable for use between a rotatable component and a stationary component of a gas turbine engine comprising a soft, burnishable ceramic material selected from the group consisting of $BaF_2$, $CaF_2$, $MgF_2$ and mixtures thereof incorporated into a stronger support matrix.

3. The seal of claim 2 wherein the ceramic material is 70% $BaF_2$ and 30% $CaF_2$.

4. The seal of claim 2 wherein the ceramic material is 72% $BaF_2$, 16% $CaF_2$, and 12% $MgF_2$.

5. The seal of claim 2 wherein the rotatable component is a turbine blade and the stationary component is a turbine shroud.

6. The seal of claim 5 wherein the stronger support matrix comprises a metallic honeycomb brazed onto the stationary shroud.

7. The seal of claim 5 wherein the stronger support matrix comprises a fibrous metallic structure bonded onto the stationary shroud.

8. The seal of claim 7 wherein the soft ceramic is impregnated into pores formed by the fibrous metallic structure and comprises at least 5% of the total seal structure.

9. The seal of claim 5 wherein the stronger support matrix comprises a high temperature ceramic selected from the group consisting of stabilized zirconia, alumina, and the like.

10. The seal of claim 9 wherein at least about 5% to 50% of the total seal mixture is the soft, burnishable ceramic material, the remainder being the high temperature ceramic matrix.

11. The seal of claim 2 wherein said stronger support matrix is a porous powdered metal bonded to said stationary component.

12. The seal of claim 2 wherein said stronger support matrix includes a hard, high temperature ceramic held within the cells of a metallic honeycomb attached to said stationary component.

13. The seal of claim 12 wherein said high temperature ceramic is stabilized zirconia.

14. The seal of claim 2 wherein said soft, burnishable ceramic material has a melting temperature higher than the maximum service temperature of the as turbine engine.

15. In a gas turbine engine of the type having rotating blades surrounded by a stationary shroud, and including an abradable seal attached to the stationary shroud and adapted to be contacted at least briefly by the rotating blades, the improvement comprising:

a soft, burnishable fluoride containing ceramic material mixed into the abradable seal so as to form from about 5% to 50% of the seal volume.

16. A method of making a seal structure, of the type used between the rotating blades and the stationary shroud of a gas turbine engine, comprising the steps of:

bonding a porous support matrix to an interior portion of a shroud wall, then impregnating the porous support matrix with a soft, burnishable, ceramic material selected from the group of fluoride compounds including $BaF_2$, $CaF_2$, $MgF_2$ and mixtures thereof.

17. The method of claim 16 wherein the step of bonding a porous support matrix includes brazing a metallic honeycomb to the shroud wall, and the step of impregnating includes filling the cells of the honeycomb with the soft ceramic.

18. The method of claim 16 wherein the step of bonding a porous support matrix includes brazing a fibrous metallic structure onto the shroud wall.

19. The method of claim 16 wherein the step of bonding a porous support matrix includes spraying a powdered metal onto the shroud wall.

* * * * *